US009490596B1

(12) United States Patent
Yu et al.

(10) Patent No.: US 9,490,596 B1
(45) Date of Patent: Nov. 8, 2016

(54) ELECTRICAL CONTACT ASSEMBLY

(71) Applicant: ALLTOP ELECTRONICS (SUZHOU) LTD., Taicang, JiangSu Province (CN)

(72) Inventors: Wang-I Yu, Jhonghe (TW); I-Hung Cheng, Jhonghe (TW); Shang-Ming Wu, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 14/862,721

(22) Filed: Sep. 23, 2015

(30) Foreign Application Priority Data

Jul. 16, 2015 (CN) ..... 2015 1 0418458

(51) Int. Cl.
*H01R 13/10* (2006.01)
*H01R 24/60* (2011.01)
*H01R 107/00* (2006.01)

(52) U.S. Cl.
CPC ..... *H01R 24/60* (2013.01); *H01R 2107/00* (2013.01)

(58) Field of Classification Search
CPC ..... H01R 23/725; H01R 23/7073
USPC ..... 439/682, 78, 79, 660, 507, 825, 907, 439/947
See application file for complete search history.

(56) References Cited

U.S. PATENT DOCUMENTS 5,618,187 A * 4/1997 Goto ..... H01R 9/091 439/79
8,096,814 B2 * 1/2012 Schell ..... H01R 13/11 439/79
8,187,017 B2 * 5/2012 Daily ..... H01R 13/113 439/290
8,388,389 B2 * 3/2013 Costello ..... H01R 13/18 439/637
9,054,456 B2 * 6/2015 Orris ..... H01R 13/112
2002/0193019 A1 * 12/2002 Blanchfield ..... H01R 9/091 439/857

* cited by examiner

*Primary Examiner* — Phuongchi T Nguyen
(74) *Attorney, Agent, or Firm* — Sughrue Mion, PLLC

(57) ABSTRACT

An electrical contact assembly includes a pair of contacting members and a cable receiving member fixed with the contacting members. Each of the contacting members is in a shape of sheet and opposite to each other. The pair of contacting members is formed separately and defines a front-to-rear direction. The cable receiving member is formed separately from the pair of contacting members or is formed integrally with one of the contacting members. As the pair of contacting members is formed separately, the manufacturing process is simple and the quality is easy to control. The symmetry accuracy of the pair of contacting portions will also be controlled perfectly. As a result, a power loss of an electric current will be decreased.

20 Claims, 9 Drawing Sheets

ELECTRICAL CONTACT ASSEMBLY

BACKGROUND OF THE INVENTION

1. Field of the Invention

The present invention generally relates to an electrical contact assembly, and particularly to electrical contact assembly assemble in an electrical connector that with bus bar and cables.

2. Description of Related Art

The U.S. Pat. App. No. 2014/0273664 A1 publicized on Sep. 18, 2014 discloses an electrical connector. The electrical connector defines a mating end and a cable connecting end. At the mating end, the electrical connector has an insulative housing and a contact assembly received in the insulative housing. The contact assembly includes a pair of contacts formed integrally. The pair of contacts includes a pair of contacting portions which are symmetrical with each other and a bridge portion connecting rear ends of the pair of contacting portions. At the cable connecting end, the contact assembly further includes a pair of half-cylinder cable receiving portion which extends rearward from two opposite side of the bridge portion to receive a cable. For the contact assembly, as the pair of contacts is formed integrally and the annular receiving portion is also formed integrally with the pair of contacts, they are formed by many complicated bending manufacturing steps. The bending manufacture process is complicated and the quality is difficult to control. Specifically, when bend the bridge portion which is located at the rear ends of the pair of contacting portions, the symmetry accuracy of the pair of contacting portions should be taken into account. The symmetry accuracy of the pair of contacting portions will influence the engagement of the contact with the insulative housing and will also influence the contacting effect of the contacting portions with an according mating connector. If the bending processes are not controlled perfectly, the transmit effect of the electric current between the electrical connector and will be lost.

For the pair of semicircular cable receiving portion which extends rearward from two literal side of the bridge portion, which are also bent form the bridge portions by many bending steps and also needed to be bent to a semicircular shape to form the cable receiving portion. On the other hand, in use, a circular ring is needed to enclose the annular receiving portion to fix the cable in the annular receiving portion.

Hence, it is desirable to provide an improved electrical contact assembly assembled in an electrical connector, which is easily to manufactured and have good electric current transmit effect.

BRIEF SUMMARY OF THE INVENTION

An object of the present invention is to provide an electrical contact assembly, which is easily manufactured and with good electric current transmit effect.

The present invention provides an electrical contact assembly including a pair of contacting members and a cable receiving member fixed with the contacting members. Each of the contacting members is in a shape of sheet and opposite to each other. The pair of contacting members is formed separately and defines a front-to-rear direction. The cable receiving member is formed separately from the pair of contacting members or is formed integrally with one of the contacting members. As the pair of contacting members is formed separately, the manufacturing process is simple and the quality is easy to control. The symmetry accuracy of the pair of contacting portions will also be controlled perfectly. As a result, a power loss of an electric current will be decreased.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
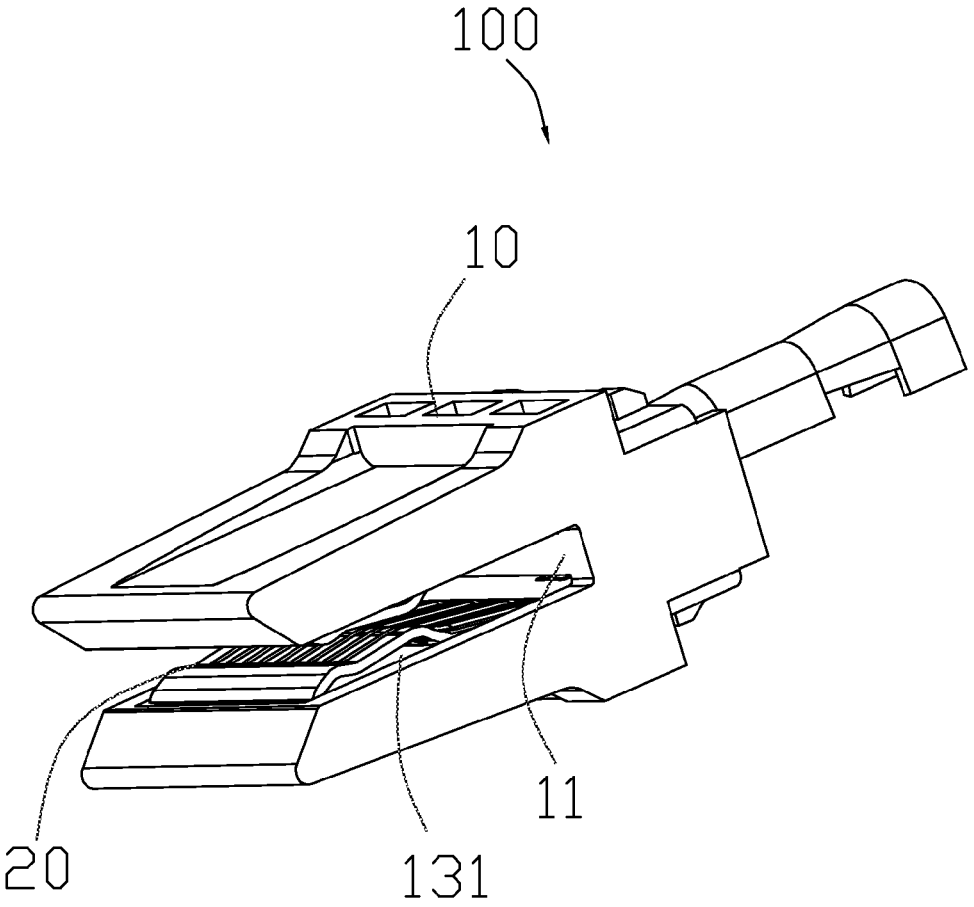
FIG. 1 is a perspective view of an electrical connector with an electrical contact assembly in accordance with an illustrated embodiment of the present invention.
Figure 2:
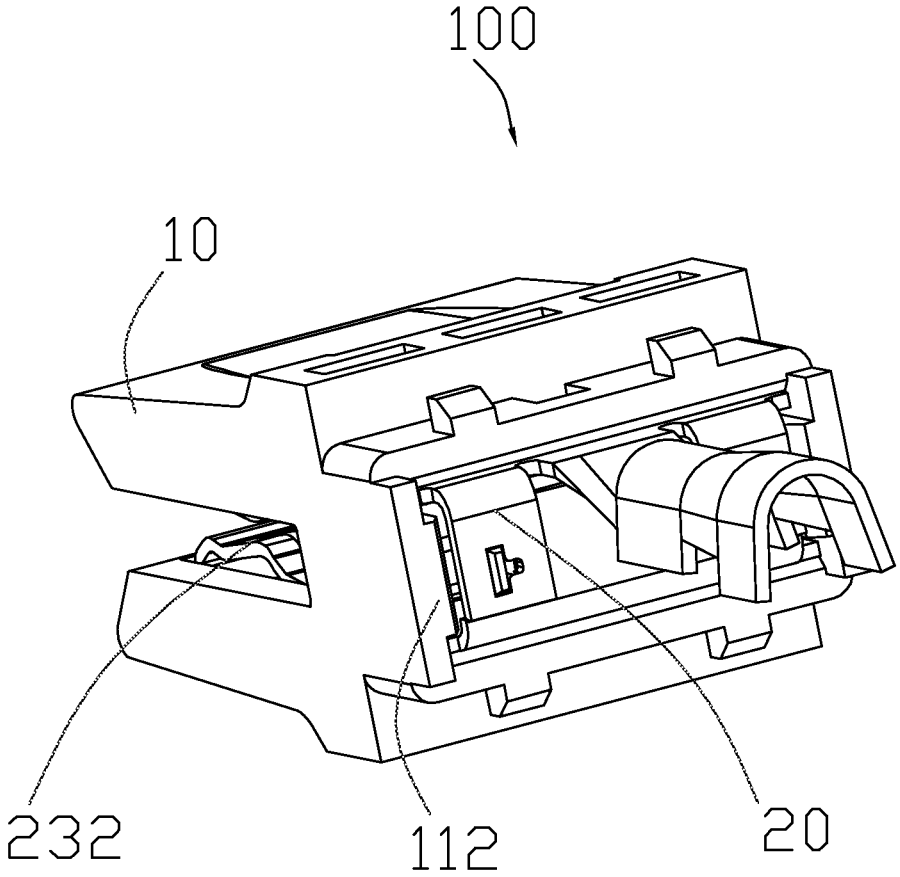
FIG. 2 is another perspective view of the electrical connector shown in FIG. 2, while taken from a different aspect.

Reference will now be made to the drawing figures to describe the embodiments of the present invention in detail. In the following description, the same drawing reference numerals are used for the same elements in different drawings.

FIGS. 1-5 illustrate a first exemplary embodiment of an electrical connector 100. The electrical connector 100 includes a generally U-shaped insulative housing 10 having a base 11 and a first and a second tongue portions 12, 13 depending generally perpendicularly from a first end 111 of the base 11. The first and second tongue portions 12, 13 are generally parallel to each other. The base 11, the first and second tongue portions 12, 13 thereby cooperate to define an interior recess 14 of the insulative housing 10 adapted to receive a bus bar (not shown) or other mating connector element.

The insulative housing 10 defines a first and a second channels 113, 114. Each of first and second channels 113, 114 extends from the first end 111 of base 11 through to the opposite, free end 112 of base 11. Each of first and second channels 113, 114 communicates with the interior recess 14. Each of first and second channels 113, 114 is generally rectangular and can span nearly the entire width of base 11 or some lesser width. The insulative housing 10 further includes a divider 118 to separates the first channel 113 from the second channel 114. Each of first and second tongue portions 12, 13 defines an inner surface (not labeled) facing interior recess 14 of the housing 10. The inner surfaces are substantially parallel to each other. Each of first and second tongue portions 12, 13 further defines a recessed receiving spaces 131 recessed from corresponding inner surface. The recessed receiving spaces 131 communicate with corresponding first and second channels 113, 114. The recessed receiving spaces 131 and the first and second channels 113, 114 cooperate to receive a pair of electrical contacting members 21, 23, as will be discussed further below.

The electrical connector further includes an electrical contact assembly 20 which has a pair of contacting members 21, 23 and a cable receiving member 25. The pair of contacting members 21, 23 is substantially in a shape of sheet. To make the description more clearly, we can illustrate the pair of contacting members 21, 23 respectively as a first contacting member 21 and a second contacting member 23. In this embodiment, the first and the second contacting members 21, 23 are formed separately and define a front-to-rear direction. Each of the contacting members 21, 23 defines a base portion 211, 231, a contacting portion 212, 232 extending forwardly from the base portion 211, 231 and an engaging portion 215, 235 connecting with the base portion 211, 231 and arranged at a rear end 213 of the contacting member 21, 23. The base portion 211 and the contacting portion 212 of the first contacting member 21 are opposite to the base portion 231 and the contacting portion 232 of the second contacting member 23. The engaging portions 215, 235 of the pair of contacting members 21, 23 engaged with each other together, as will be discussed further below.

The engaging portions 215, 235 of the pair of contacting members 21, 23 are bent from the base portion 211, 231, respectively, in a direction perpendicular to the front-to-rear direction. The engaging portion 215 of the first contacting member 21 extends toward to the engaging portion 235 of the second contacting member 23. The engaging portion 235 of the second contacting member 23 is a piece of sheet and defines a pair of opposite edges perpendicular to the base portion 231. The engaging portion 235 defines a pair of tabs 237 extending rearwardly therefrom and perpendicular thereto. In this embodiment, the tabs 237 are a pair of protrusions bent rearwardly from two opposite edge of the engaging portion 235 of the second contacting member 23.

Correspondingly, the engaging portion 215 of the first contacting member 21 defines a pair of engaging openings 217 which engages with the tab 237. In this embodiment, the engaging portion 215 of the first contacting member 21 is a pair of ears (also labeled as 215) bent from and perpendicular to the base portion 211. The engaging openings 217 are a pair of through openings defined in the pair of ears 215 respectively.

Figure 3:
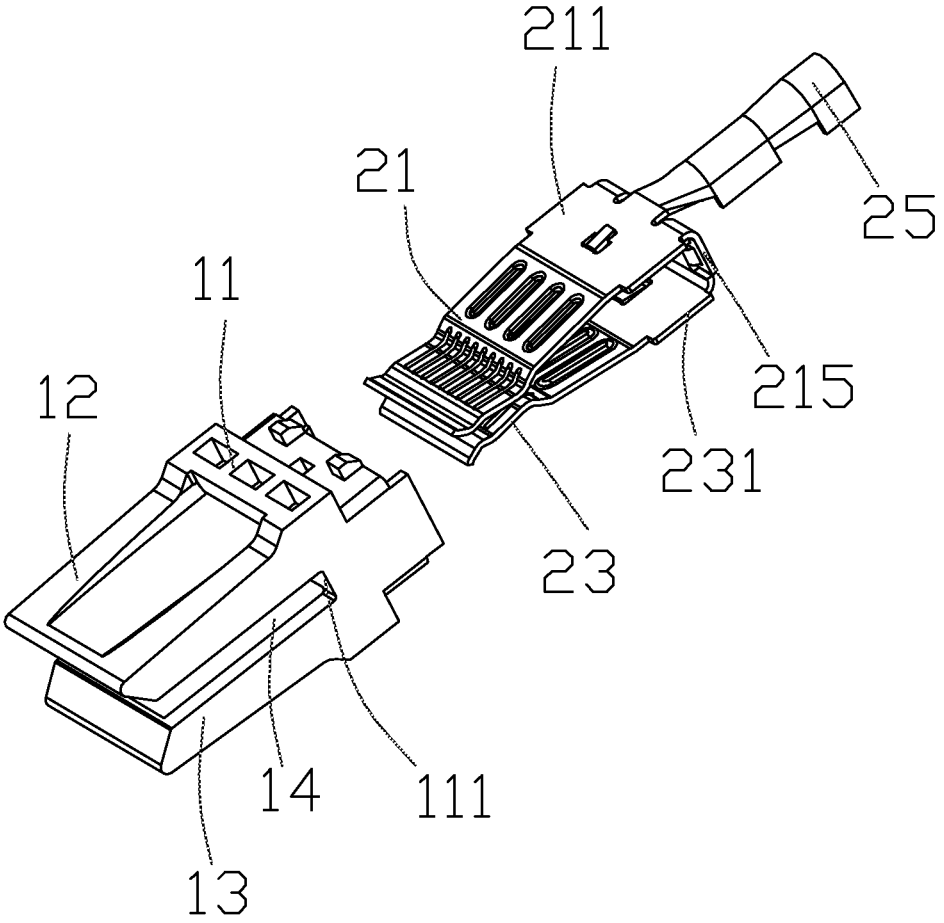
FIG. 3 is an exploded view of the electrical connector shown in FIG. 1.
Figure 4:
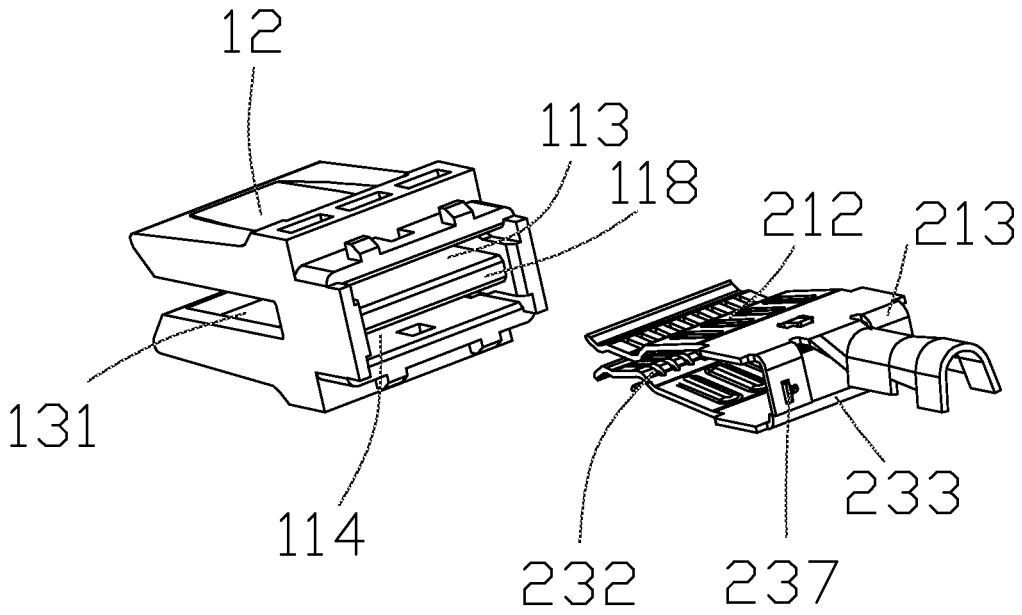
FIG. 4 is another exploded view of the electrical connector shown in FIG. 2.
Figure 5:
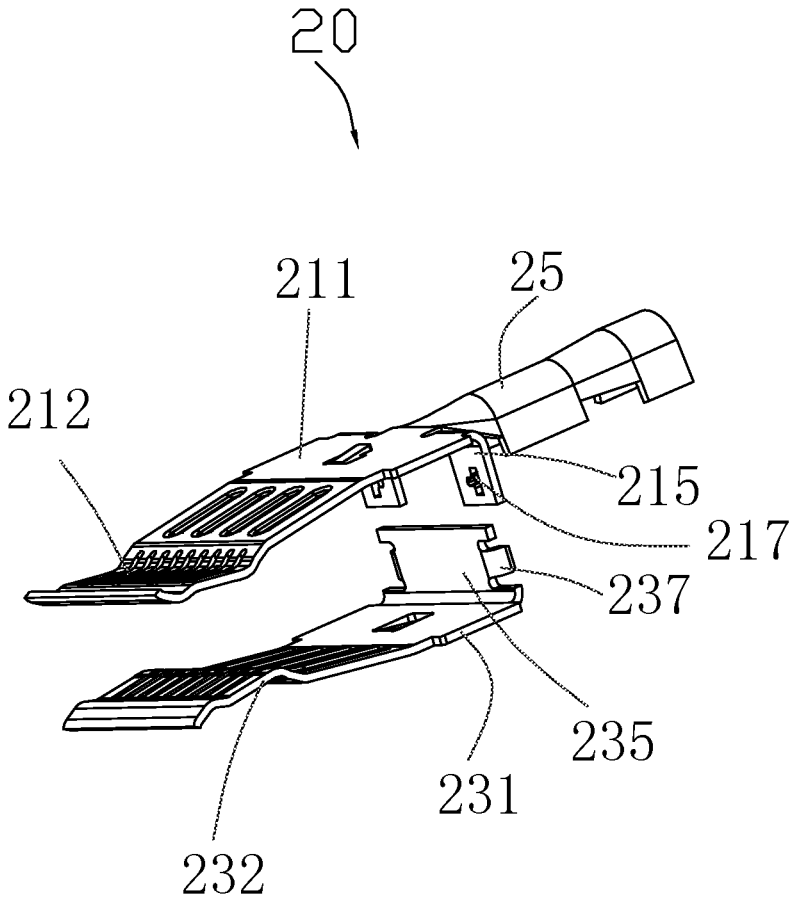
FIG. 5 is an exploded view of the electrical contact assembly shown in FIG. 3.

As shown in FIGS. 3-5, in the first embodiment, the cable receiving member 25 is formed integrally with the first contacting member 21. Of course, in other embodiments, the cable receiving member 25 could be formed integrally with the second contacting members 23, as would be understood by one skilled in the art. In this embodiment, the cable receiving member 25 extends rearwardly from the base portion 211 of the first contacting member 21. The engaging portion 215 of the first contacting member 21 is located between the base portion 211 and cable connecting member 25 in the front-to-rear direction. In this embodiment, the cable receiving member 25 is half-cylinder and is located between the pair of ears 215 of the first contacting member 21 in a transverse direction of the first contacting member 21.

In assembly, the tabs 237 pass through the engaging opening 217 and welded together with each other to form the electrical contact assembly 20. In other embodiments, the tabs 237 pass through the engaging opening 217 and then the tabs 237 could be bent to make the two contacting member 21, 23 be fixed together, as would be understood by one skilled in the art. Then, the contact assembly 20 is assembled in the insulative housing 10. The pair of contacting members 21, 23 is substantially received in the insulative housing 10 and the cable receiving member 25 is outside of the insulative housing 10. The base portions 211, 231 are received in first and second channels 113, 114 respectively and the contacting portion 212, 232 are received in the receiving spaces 131 recessed in the first and second tongue portion 12, 13. Part of the contacting portion 212, 232 extend into the interior recess 14 to contact with a mating connector element (not shown).

For the first exemplary embodiment according to the present invention, as the pair of contacting members 21, 23 is formed separately, the manufacturing process is simple and the quality is easy to control. The symmetry accuracy of the pair of contacting portions 212, 232 will also be controlled perfectly. As a result, a power loss of an electric current will be decreased with respect to prior arts.

Figure 6:
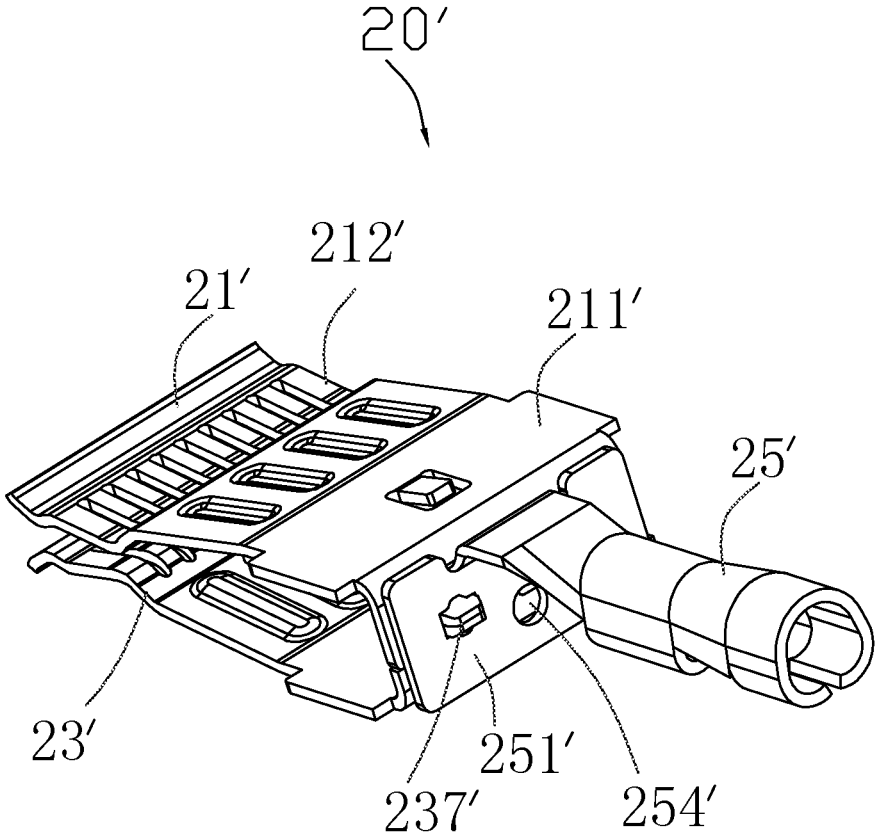
FIG. 6 is a perspective assembled view of an electrical contact assembly with a second illustrated embodiment of the present invention.
Figure 7:
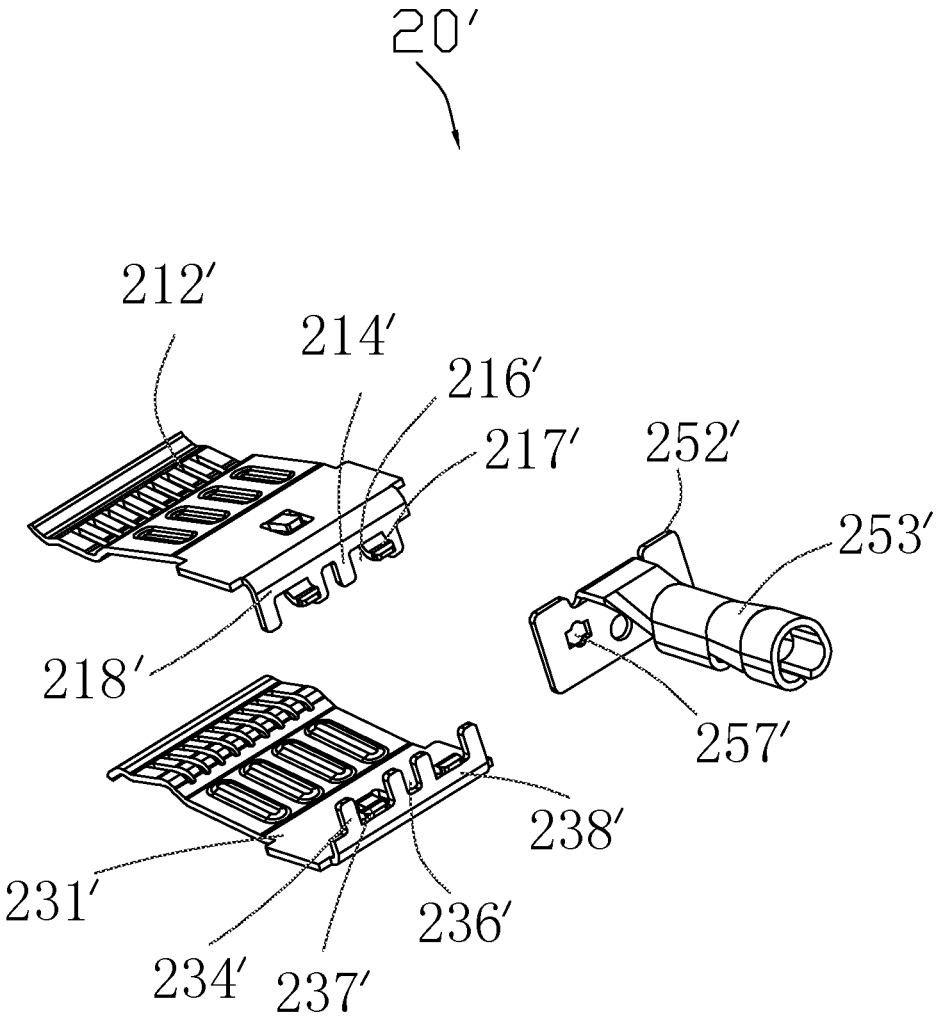
FIG. 7 is an exploded view of the electrical contact assembly shown in FIG. 6.
Figure 8:
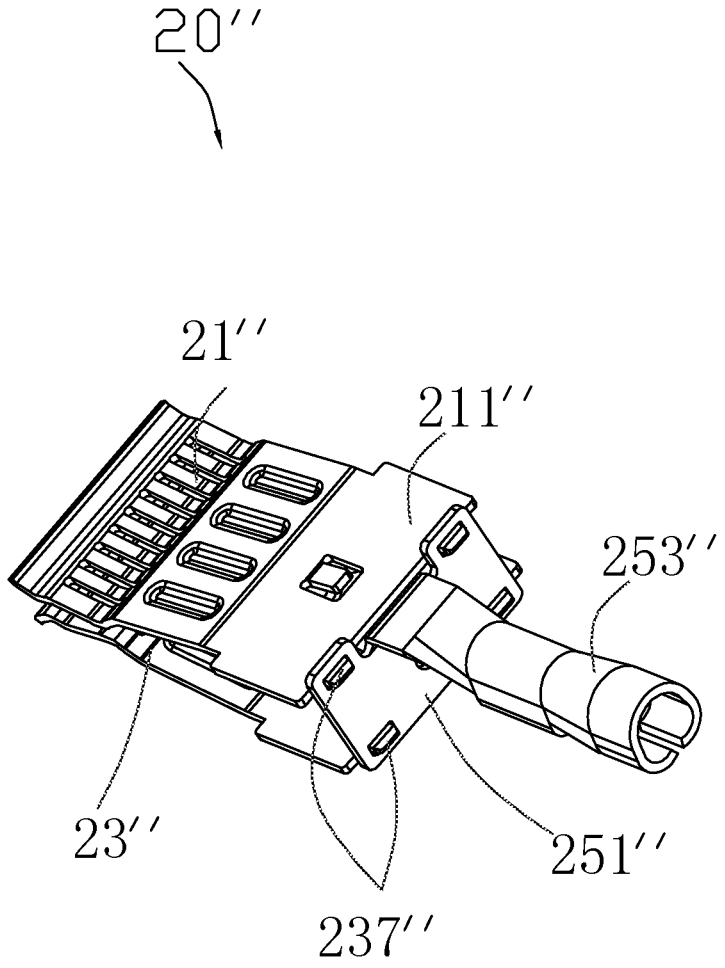
FIG. 8 is a perspective assembled view of an electrical contact assembly with a third illustrated embodiment of the present invention.
Figure 9:
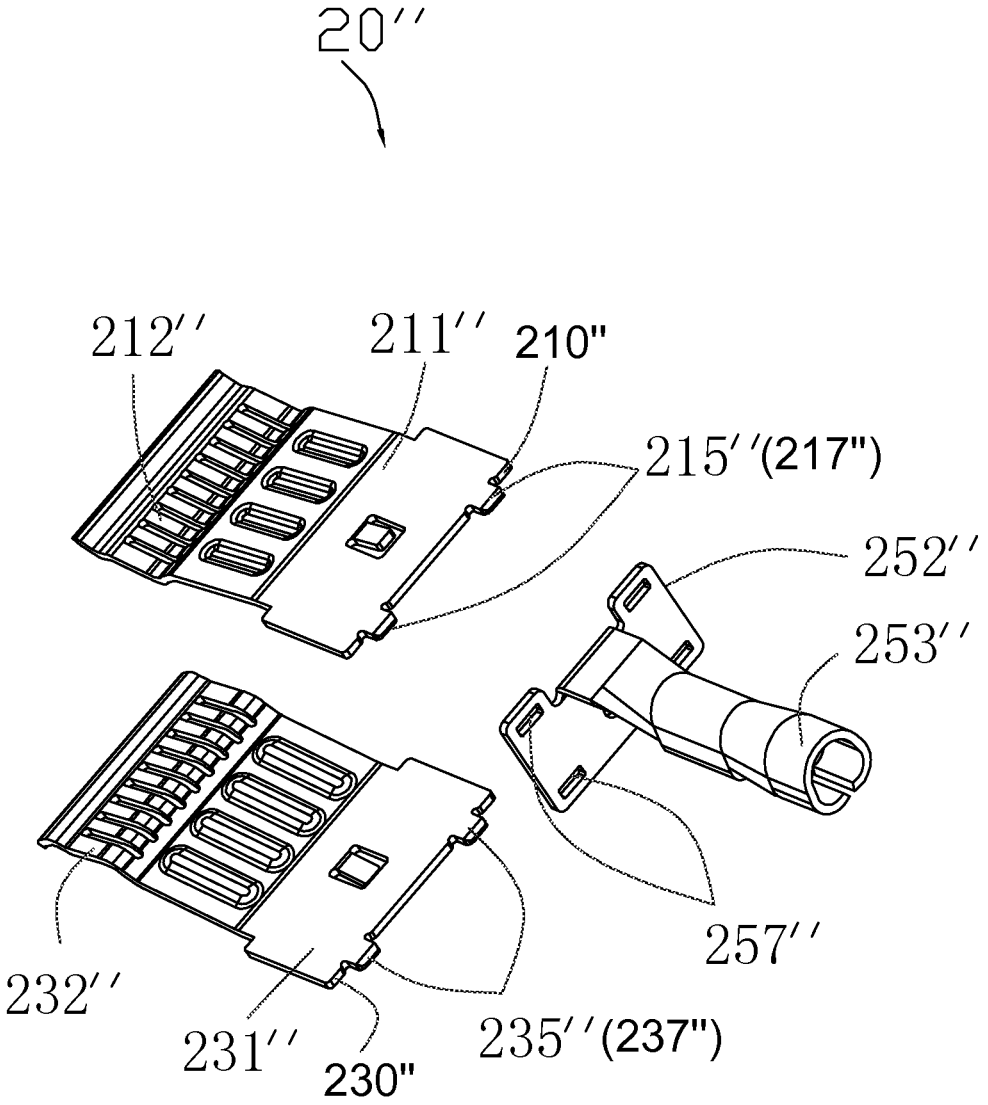
FIG. 9 is an exploded view of the electrical contact assembly shown in FIG. 8.

FIGS. 6-7 illustrate a second exemplary embodiment of an electrical contact assembly 20' and FIGS. 8-9 illustrate a third exemplary embodiment of an electrical contact assembly 20". Both the electrical contact assembly 20' and the electrical contact assembly 20" can be assembled in the insulative housing 10 in the first embodiment. So the drawing and corresponding description for the insulative housing 10 is omitted here for the second embodiment and third embodiment. In the second embodiment and third embodiment, the first contacting member 21' (21") and the second contacting member 23' (23") are also formed separately. Most of the respects of the electrical contact assemblies 20' (20") are similar to what of electrical contact assembly 20 as shown in the first embodiment. The difference will be discussed below.

Refers to FIGS. 6-7, the electrical contact assembly 20' includes pair of contacting members 21', 23' and a cable receiving member 25'. The difference between the electrical contact assembly 20' in this embodiment and the electrical contact assembly 20 in the first embodiment is the arrangement for engaging portions 215, 235 (215', 235') and the relationship of the cable receiving member 25 (25') with the contacting members 21, 23 (21', 23'). In this embodiment, the cable receiving member 25' is formed separately from the pair of contacting members 21', 23'. The cable connecting member 25' has a fixing portion 251' fixed with the engaging portions 215', 235' and a cable receiving portion 253' extending rearwardly form the fixing portion 251'. The fixing portion 251' is a piece of sheet and includes a heat-release through hole 254' at a central position thereof. The cable receiving portion 253' is substantially perpendicular to the fixing portion Refers to FIGS. 6-7, each of engaging portions 215', 235' includes a pair of tabs 217', 237' extending rearwardly therefrom and perpendicular thereto, and accordingly the fixing portion 251' defines at least a pair of engaging openings 257' to engage with the tabs 237' to assemble the pair of contacting members 21', 23' and the cable receiving member 25' together. The engaging portions 215', 235' are bent from the base portion 211', 231' in an up-to-down direction perpendicular to the front-to-rear direction. The engaging portion 215' of the first contacting member 21' extends toward to the engaging portion 235' of the second contacting member 23'. Each of the engaging portions 215', 235' defines a plurality of ears 214', 234' and a plurality of notches 216', 236' which is arranged alternative with the ears 214', 234'.

In the second embodiment as shown in FIGS. 6 and 7, the tabs 217', 237' are arranged in a manner that the tabs 217', 237' are stamped and bent rearwardly from the engaging portions 215', 235' and located between two adjacent ears 214', 234'. The pair of the tabs 217' of the engaging portion 215' of the first contacting member 21' is aligned with another pair of tabs 237' of the engaging portion 235' of the first contacting member 23' in the up-to-down direction.

In assembly, the ears 214'/234' of the engaging portions 215'/235' are received in the notches 216'/236' of another engaging portion 235'/215' resulting that an outer side 218', 238' of the pair of engaging portions 215', 235' are coplanar with each other. Meanwhile, the pair of the tabs 217' of the engaging portion 215' contacts against another pair of tabs 237' of another engaging portion 235' in the up-to-down direction. And further, the tabs 217' cooperate the tabs 237' pass through the engaging opening 257' and welded together with each other to form the electrical contact assembly 20'. An inner side 252' of the fixing portion 251' contacts against the outer sides 218', 238' of the pair of engaging portions 215', 235'. In other embodiments, the tabs 217' and 237' pass through the engaging opening 257' and then the tabs 217' and 237' could be bent to make the two contacting member 21', 23' and the cable receiving member 25' be fixed together, as would be understood by one skilled in the art.

In the third embodiment as shown in FIGS. 8 and 9, the engaging portions 215", 235" are two pairs of tabs 217', 237' protrude directly from a rear edge 210", 230" of the base portion 211", 231". The engaging openings 257" are arranged in a manner that the engaging openings 257" are two pair of through openings defined in the fixing portion 251" to receive the two pair of tabs 217', 237'. In this embodiment the engaging portions 215", 235" do not contact with each directly. In assembly, the two pairs of tabs 217', 237' pass through the two pairs of engaging openings 257" and welded together with each other to form the electrical contact assembly 20' including the pair of contacting members 21", 23" and the cable receiving member 25". An inner side 252" of the fixing portion 251" contacts against the rear edge 210", 230" of the base portion 211", 231" of the pair of contact members 21, 23. In other embodiments, the tabs 217" and 237" pass through the engaging opening 257" and then the tabs 217" and 237' could be bent to make the two contacting member 21", 23" and the cable receiving member 25" be fixed together, as would be understood by one skilled in the art.

For the second and third exemplary embodiment according to the present invention, as the pair of contacting members 21' (21"), 23' (23") and the cable receiving members 25' (25") are all formed separately, the manufacturing process is more simple and the quality is easy to control. The symmetry accuracy of the pair of contacting portions 212' (212"), 232' (232") will also be controlled perfectly. As a result, a power loss of an electric current will be decreased with respect to prior arts.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical contact assembly, comprising:

a pair of contacting members, which is substantially in a shape of sheet, the pair of contacting members being formed separately and defines a front-to-rear direction, each of the contacting members defining a base portion, a contacting portion extending forwardly from the base portion and an engaging portion connecting with the base portion and arranged at a rear end of the contacting member, the base portion and the contacting portion of one contacting member are opposite to the base portion and the contacting portion of another contacting member, the engaging portions of the pair of contacting members engaged with each other;

a cable receiving member, which is formed integrally with one of the contacting members, the cable receiving member extending rearwardly from the base portion and the engaging portion is located between the base portion and cable connecting member.

2. The electrical contact assembly as claimed in claim 1, the electrical contact is adapted to an electrical connector which comprising an insulative housing, wherein the pair of contacting members is received in the insulative housing and the cable receiving member is outside of the insulative housing.

3. The electrical contact assembly as claimed in claim 1, wherein the engaging portions are bent from the base portion in a direction perpendicular to the front-to-rear direction, and the engaging portion of one contacting member extends toward to the engaging portion of another contacting member.

4. The electrical contact assembly as claimed in claim 3, wherein one of the engaging portion defines a tab extending rearwardly therefrom, and wherein another engaging portion defines an engaging opening which engages with the tab.

5. The electrical contact assembly as claimed in claim 4, wherein the tab passes through the engaging opening and welded together with each other.

6. The electrical contact assembly as claimed in claim 4, wherein the tab is arranged in a manner that the tab is a pair of protrusions which projects rearwardly from two opposite edges of the engaging portion of one contacting member.

7. The electrical contact assembly as claimed in claim 6, wherein another engaging portion of another contacting member is arranged in a manner that which is a pair of ears bent from the base portion and perpendicular to the base portion, and wherein the engaging opening is arranged in a manner that the engaging opening is a pair of through openings defined in the pair of protrusions respectively.

8. The electrical contact assembly as claimed in claim 7, wherein the cable receiving member is half-cylinder and is located between the pair of ears in a transverse direction of the contacting members.

9. An electrical contact assembly, comprising:

a pair of contacting members, which is in a shape of sheet, the pair of contacting members being formed separately and defines a front-to-rear direction, each of the contacting members defining a base portion, a contacting portion extending forwardly from the base portion and an engaging portion connecting with the base portion and arranged at a rear end of the contacting member, the base portion and contacting portion of one contacting member is opposite to the base portion and contacting portion of another contacting member;

a cable receiving member, which is formed separately from the pair of contacting members, the cable connecting member having a fixing portion fixed with the engaging portions and a cable receiving portion extending rearwardly form the fixing portion.

10. The electrical contact assembly as claimed in claim 9, wherein the each of engaging portions comprises a pair of tabs, and accordingly the fixing portion comprises at least a pair of engaging openings engaging with the tabs resulting that the pair of contacting members and the cable receiving member be fixed together.

11. The electrical contact assembly as claimed in claim 10, wherein the tabs pass through the engaging opening and welded together with each other.

12. The electrical contact assembly as claimed in claim 10, the electrical contact is adapted to an electrical connector which comprising an insulative housing, wherein the pair of contacting members is received in the insulative housing and the cable receiving member is outside of the insulative housing.

13. The electrical contact assembly as claimed in claim 10, wherein the tabs are arranged in a manner that the tabs protrude directly from a rear edge of the base portion, and wherein the engaging openings are arranged in a manner that the engaging openings are two pair of through openings defined in the fixing portion to receive the two pair of tabs.

14. The electrical contact assembly as claimed in claim 13, wherein an inner side of the fixing portion of the cable receiving member contacts against the rear edge of the base portion of the pair of contact members.

15. The electrical contact assembly as claimed in claim 10, wherein the fixing portion is a piece of sheet and the engaging openings are defined therein, and further the fixing portion comprises a heat-release through hole at a central position thereof.

16. The electrical contact assembly as claimed in claim 15, wherein the cable receiving portion is substantially perpendicular to the fixing portion.

17. The electrical contact assembly as claimed in claim 10, wherein the engaging portions are bent from the base portion in an up-to-down direction perpendicular to the a front-to-rear direction, and wherein the engaging portion of one contacting member extends toward to the engaging portion of another contacting member and engages with each other together.

18. The electrical contact assembly as claimed in claim 17, wherein each of the engaging portions defines a plurality of ears and a plurality of notches which is arranged alternative with the ears, the ears of one engaging portion being received in the openings of another engaging portion resulting that an outer side of the pair of engaging portions are coplanar with each other.

19. The electrical contact assembly as claimed in claim 18, wherein the tabs are arranged in a manner that the tabs are stamped and bent rearwardly from the engaging portions and located between two adjacent ears, the pair of the tabs of one engaging portion aligned with another pair of tabs of another engaging portion in the up-to-down direction, and wherein when the pair of engaging portions engaged together, the pair of the tabs of one engaging portion contacts against another pair of tabs of another engaging portion in an up-to-down direction.

20. The electrical contact assembly as claimed in claim 19, wherein when the contact members and the cable receiving member are fixed together, an inner side of the fixing portion of the cable receiving member contacts against the outer side of the pair of engaging portion of contact members.

* * * * *